US011148261B2

(12) United States Patent
Molina et al.

(10) Patent No.: US 11,148,261 B2
(45) Date of Patent: Oct. 19, 2021

(54) REVERSIBLE HAND TOOL

(71) Applicant: Klein Tools, Inc., Lincolnshire, IL (US)

(72) Inventors: Daniel Molina, Mansfield, TX (US); Kevin A. Ekdahl, Libertyville, IL (US); Raul Rosales, Dallas, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 344 days.

(21) Appl. No.: 16/175,325

(22) Filed: Oct. 30, 2018

(65) Prior Publication Data

US 2019/0126445 A1 May 2, 2019

Related U.S. Application Data

(60) Provisional application No. 62/578,789, filed on Oct. 30, 2017.

(51) Int. Cl.

| | |
|---|---|
| ***B25B 15/04*** | (2006.01) |
| ***B25B 23/00*** | (2006.01) |
| ***B25G 1/08*** | (2006.01) |
| ***B25G 1/06*** | (2006.01) |

(52) U.S. Cl.

CPC ..... *B25B 15/04* (2013.01); *B25B 23/0035* (2013.01); *B25G 1/063* (2013.01); *B25G 1/085* (2013.01)

(58) Field of Classification Search

CPC ..... B25B 15/04; B25B 15/02; B25B 15/06; B25B 17/00; B25B 23/0035; B25B 13/463; B25B 13/465; B25B 13/468; B25B 23/0042; B25G 1/06; B25G 1/063; B25G 1/085

See application file for complete search history.

(56) References Cited

U.S. PATENT DOCUMENTS

| | | | | |
|---|---|---|---|---|
| 5,910,196 | A * | 6/1999 | Huang | B25B 13/463 81/60 |
| 5,967,003 | A * | 10/1999 | Lin | B25G 1/085 81/58.3 |
| 6,151,994 | A * | 11/2000 | Shiao | B25B 15/02 81/438 |
| 6,244,139 | B1 * | 6/2001 | Huang | B25B 13/463 192/43.2 |
| 6,250,183 | B1 * | 6/2001 | Chiang | B25B 13/468 81/63 |
| 6,658,970 | B2 * | 12/2003 | Shiao | B25B 13/468 192/43.1 |

* cited by examiner

*Primary Examiner* — Robert J Scruggs
(74) *Attorney, Agent, or Firm* — Leydig, Voit & Mayer, Ltd.

(57) ABSTRACT

A reversible tool holder assembly is adapted for insertion into a handle in either of two orientations to present two different ends extending from the handle. The reversible tool holder assembly includes a first barrel and a second barrel that are axially aligned, and a ratcheting mechanism that is disposed axially between the first and second barrels and configured to provide a reversible ratcheting mechanical connection between the first and second barrels. The ratcheting mechanism is configured to provide a reversible ratcheting mechanical connection or a solid mechanical connection between the two barrels.

20 Claims, 7 Drawing Sheets

REVERSIBLE HAND TOOL

CROSS-REFERENCE TO RELATED APPLICATIONS

This patent application claims the benefit of U.S. Provisional Patent Application No. 62/578,789, filed Oct. 30, 2017, which is incorporated herein in its entirety by this reference.

BACKGROUND OF THE DISCLOSURE

Ratcheting hand tools are known and, in many applications, preferred by users for the convenience they provide. In a typical ratcheting hand tool, a ratcheting mechanism is incorporated into a handle of the tool such that a reversible ratcheting action is provided between the tool handle and a tool shaft, onto which a driver bit can typically be attached.

While such tools are convenient to use, the ratcheting mechanism often adds size to the handle, especially in the width of the handle, thus impeding easy access to confined spaces. Certain designs that include metal components are also susceptible to transferring electrical voltage close to the handle when used on live electrical components, which can present a shock risk for the user. Further, incorporation of a selector dial in the handle of the tool, which selects the direction of the ratcheting action, exposes the selector dial to accidental activation by the user as the user turns the handle of the tool.

BRIEF SUMMARY OF THE DISCLOSURE

The present disclosure provides a reversible hand tool having a ratcheting mechanism incorporated into a removable tool support shaft of the tool.

More specifically, in one aspect, the disclosure describes a reversible hand tool. The reversible hand tool includes a handle having a body portion that includes a hollow bore formed at least partially through the body portion, a grip, and a reversible tool holder assembly. The reversible tool holder assembly is insertable into the hollow bore of the body portion of the handle in either of two orientations to present two different ends extending from the handle, and includes a first barrel and a second barrel that are axially aligned. A ratcheting mechanism is disposed axially between the first and second barrels and is configured to provide a reversible ratcheting mechanical connection between the first and second barrels. The ratcheting mechanism is releasably connectable with the handle in either of the two orientations such that the reversible ratcheting mechanical connection is applied between either of the two different ends extending from the handle, and the handle.

In another aspect, the disclosure describes a reversible tool holder assembly, which is adapted for insertion into a handle in either of two orientations to present two different ends extending from the handle. The reversible tool holder assembly includes a first barrel and a second barrel that are axially aligned, and a ratcheting mechanism that is disposed axially between the first and second barrels and configured to provide a reversible ratcheting mechanical connection between the first and second barrels. The ratcheting mechanism is configured to provide a reversible ratcheting mechanical connection or a solid mechanical connection between the two barrels.

In yet another aspect, the disclosure describes a method for operating a tool. The method includes providing a handle having a body portion that includes a hollow bore formed at least partially through the body portion, and a grip. The method also includes releasably inserting a reversible tool holder assembly into the hollow bore of the body portion of the handle in either of two orientations to present two different ends extending from the handle, the reversible tool holder assembly including a first barrel and a second barrel that are axially aligned; and operating a ratcheting mechanism disposed axially between the first and second barrels, the ratcheting mechanism configured to provide a reversible ratcheting mechanical connection between the first and second barrels. The ratcheting mechanism is releasably connectable with the handle in either of the two orientations such that the reversible ratcheting mechanical connection is applied between either of the two different ends extending from the handle, and the handle, independently from the handle.

DETAILED DESCRIPTION

Figure 1:
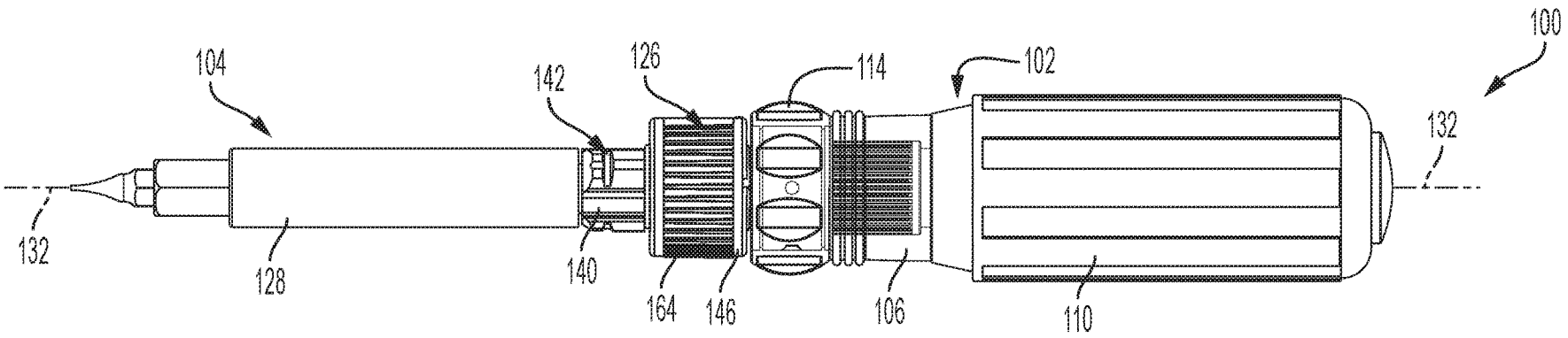
FIGS. 1 and 2 are outline views from different perspectives of a tool in accordance with the disclosure.
Figure 2:
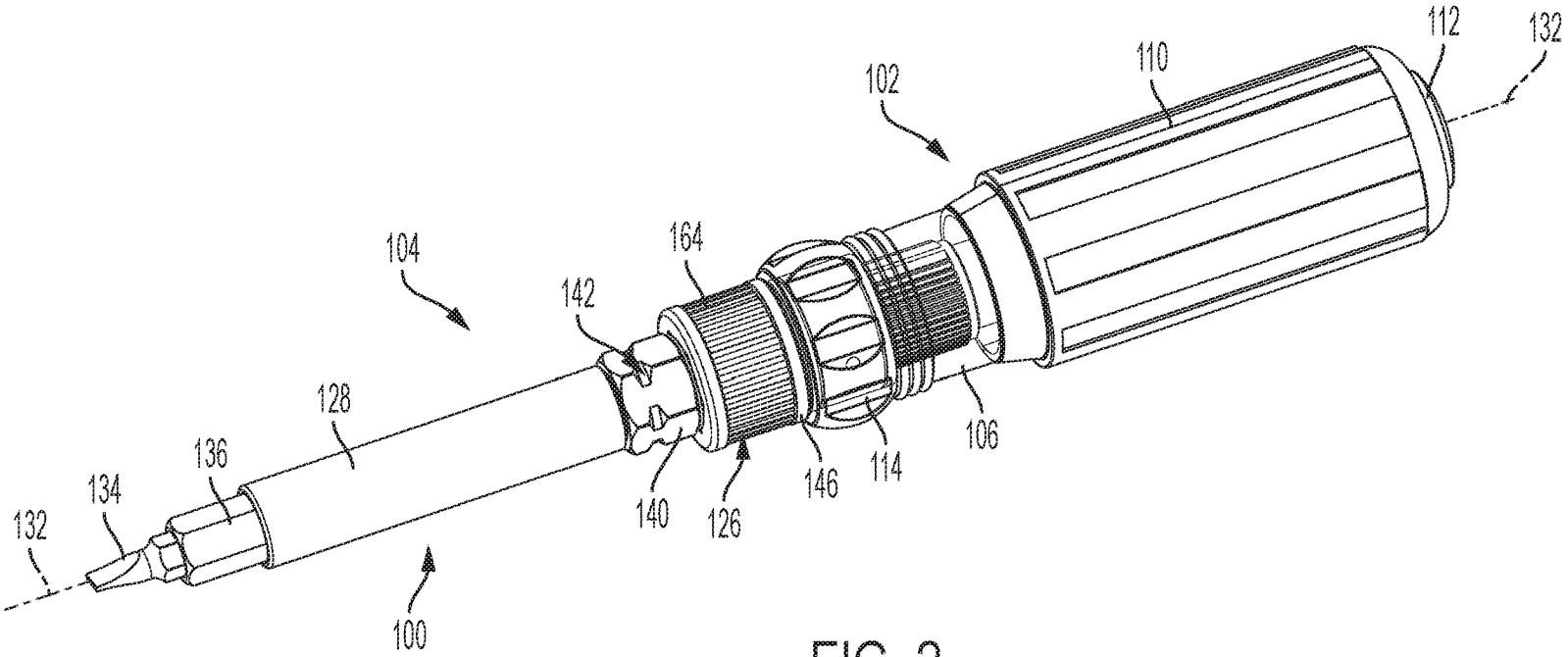
Figure 3:
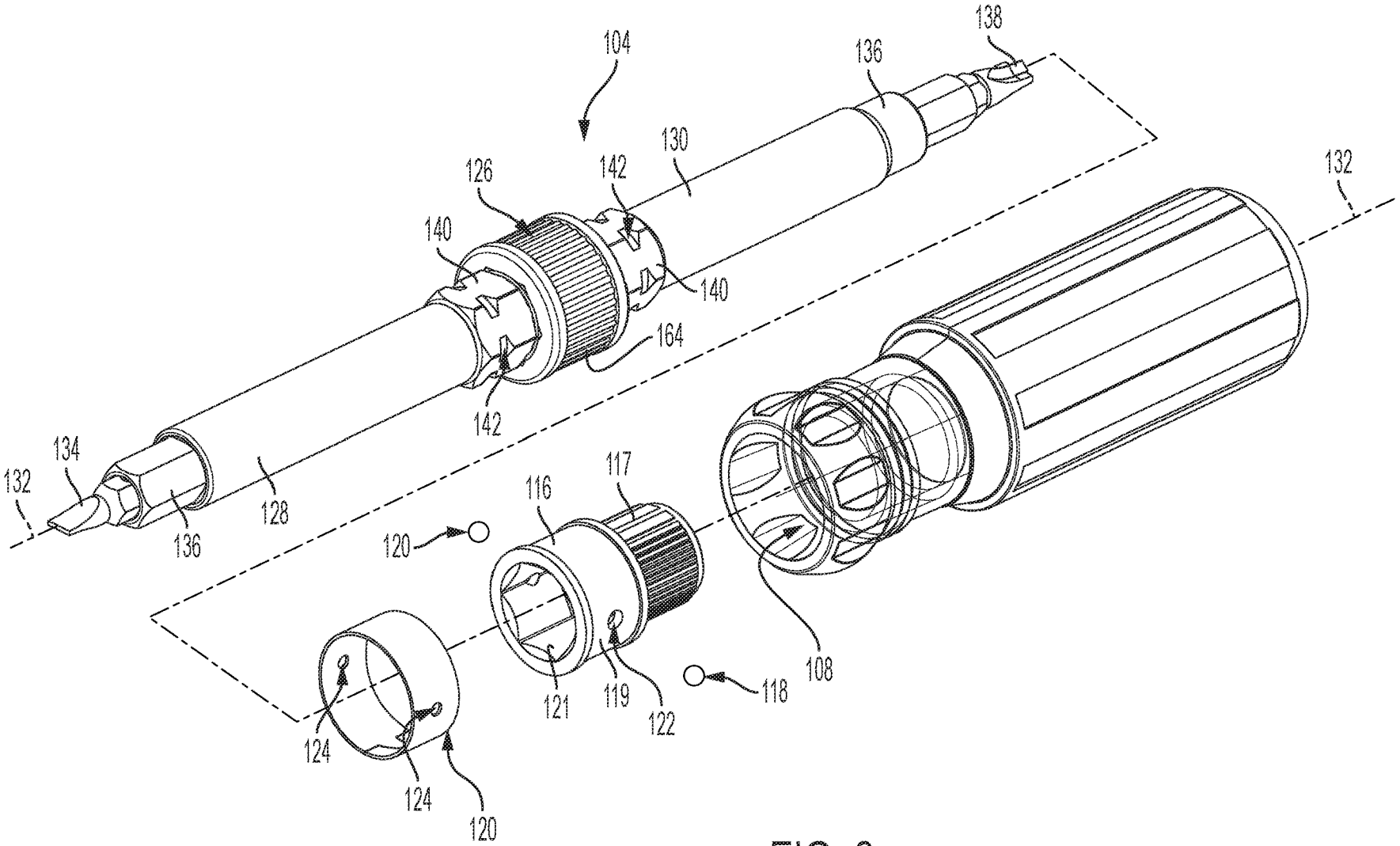
FIG. 3 is a partially disassembled view of the tool of FIGS. 1 and 2.

FIGS. 1 and 2 are outline views of a hand tool 100 from different perspectives. The tool 100, which in the illustrated embodiment is a screwdriver, includes a handle 102 and a reversible tool holder assembly 104. The handle 102 includes a body portion 106 having a bore 108 formed at least partially therethrough, as shown in FIG. 3, and a grip 110. As shown, the body portion 106 is closed at one end 112, but in an alternative embodiment it may be open to permit installation of longer tools. The body portion 106 further includes an optional, finger grip 114 around an opening of the bore 108.

In further reference to FIG. 3, the reversible tool holder assembly 104 is shown removed from the tool 100, which is shown partially disassembled. A collet 116 is press-fit into the bore 108 of the body portion 106, and is shown removed from the tool 100 for illustration. The collet 116 includes an engagement portion 117 that frictionally and, generally permanently, engages an inner surface of the body portion 106 when the tool 100 is assembled. A locking portion 119 has a generally cylindrical shape and is disposed adjacent to, and connected to, the engagement portion 117. The locking portion 119 forms an internal bore 121 having a hexagonal shape and two diametrically opposite openings 122 that extend radially to the internal bore 121 and slidably accept therein two metal spheres 118. The spheres 118 are disposed in their respective openings 122 in an assembled state and permitted to move in a radial direction while being biased in a radial, inward direction by a cylindrical ring spring 120, which is disposed around the locking portion 119 when assembled. The ring spring 120 forms two holes 124, which are aligned with and help retain the spheres 118 in place and, also, the ring spring 120 in place relative to the collet 116.

The reversible tool holder assembly 104 can be releasably inserted into the handle 102 in either of two orientations to present two different drivers or bits during use. The reversible tool holder assembly 104 also includes a ratcheting mechanism 126 that provides a rotatably engaged or reversible ratcheting mechanical connection between a first barrel 128 and a second barrel 130, which are axially aligned along a centerline 132 of the tool 100. In this arrangement, the reversible tool holder assembly 104 can be inserted and retained in the handle 102 in either direction such that the first or second barrel 128 or 130 can protrude from the handle 102 while the other is located within the bore 108 of the handle 102. The ratcheting function is entirely housed within the reversible tool holder assembly 104 such that the handle 102 can be simplified and also used to support other tool types.

Figure 4:
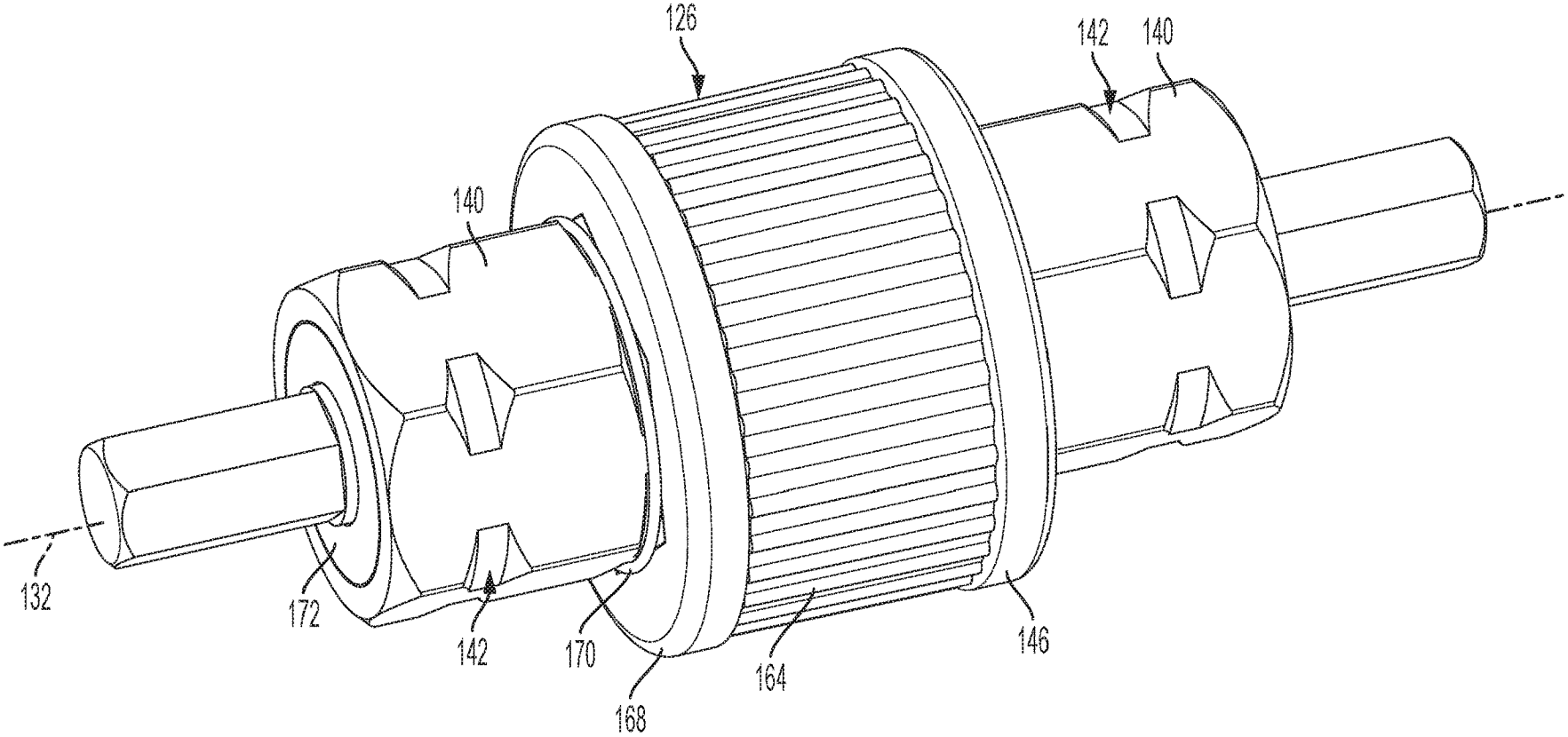
FIG. 4 is a disassembled view of a ratchet mechanism in accordance with the disclosure.

More specifically, the first barrel 128 has a generally elongate, tubular shape having one end open and configured to support a first driver 134. A spacer, extender or tool holder 136 can also be used. As shown, the first driver 134 has a conventional construction that presents a hexagonal profile that is received within a hexagonally shaped bore extending at least partially through the first barrel 128 from its free end. The second barrel 130 is similarly constructed and is shown having a second driver 138 mounted therein. Each of the first and second barrels 128 and 130 is separated from the ratcheting mechanism 126 by a hexagonal retention portion 140, which also includes a partial channel 142 formed in a radial dimension that overlaps at least partially the radial outward portions of the hexagonal shape of the retention portion 140 to form depressions that are axially shorter than the overall axial length of the retention portion 140. These features can be seen more clearly in the enlarged view of FIG. 4.

Figure 5:
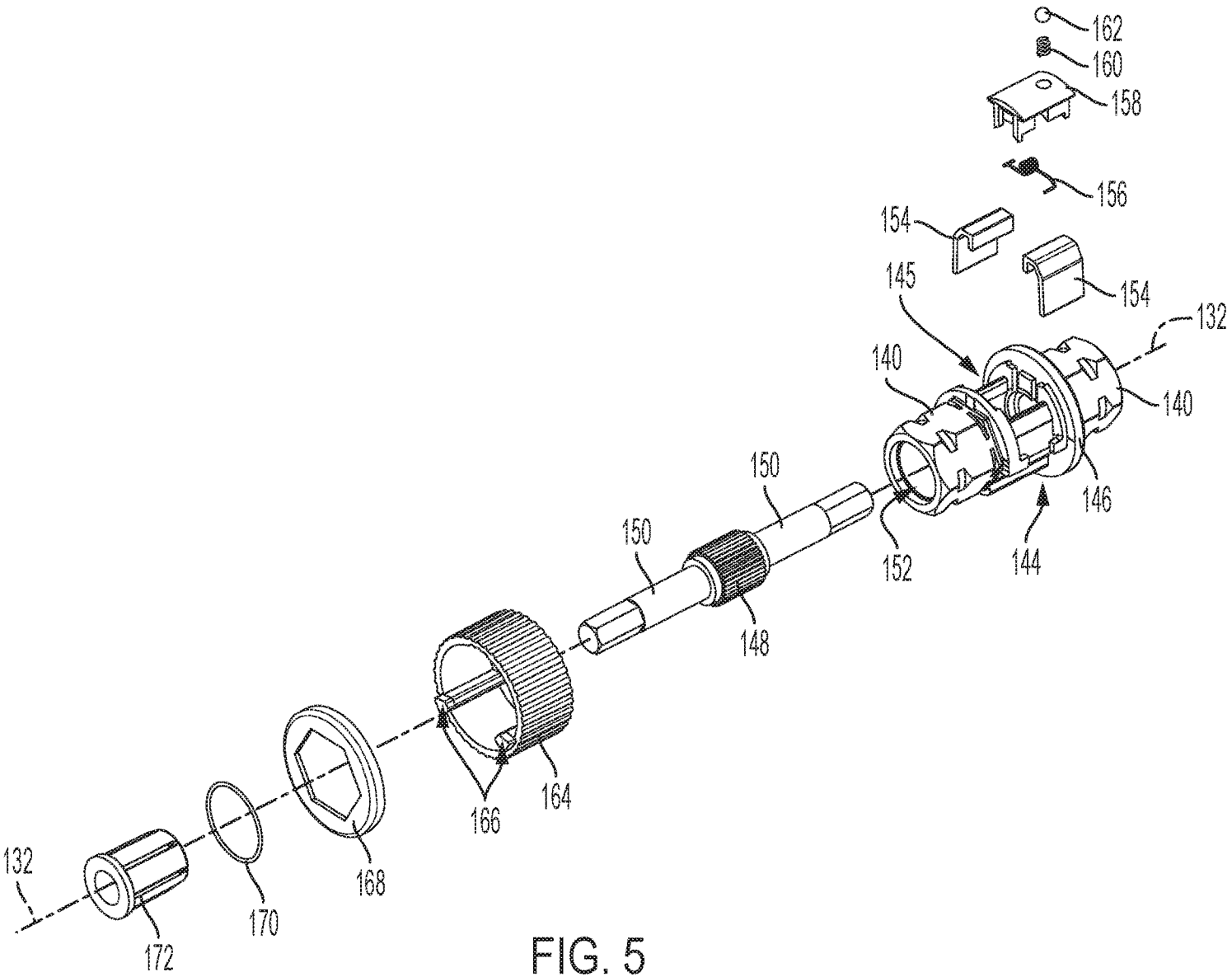
FIG. 5 is an exploded view of the ratchet mechanism of FIG. 4.

A disassembled view of the ratcheting mechanism 126 is shown in FIG. 5. In this embodiment, the ratcheting mechanism 126 is shown to include a ratchet housing 144 that is integrally formed with the retention portions 140 and includes a cavity 145 that houses components of the ratcheting mechanism. The housing 144 further includes a flange 146 adjacent the cavity 145. A spline 148 having a barrel shape is formed along a shaft 150 that rotatably extends through a bore 152 formed in the housing 144 such that the spline 148 is rotatably supported within the cavity 145. The spline 148 has teeth formed along its outer peripheral surface, which directionally engage the tips of two pawls 154 that are pivotally mounted on the housing 144 adjacent the cavity 145. A spring 156 biases the pawls 154 to selectively contact the spline 148. A cover 158 retains the pawls in position. A locking spring 160 biases a ball 162 in a radial outward direction within a bore in the cover 158 and against an inner surface of a selector dial 164 that is disposed around the housing 144 and over the cavity 145.

The selector dial 164 has a hollow cylindrical shape and includes two selector actuators 166 along an inner wall surface thereof that, depending on the rotational orientation of the selector dial 164 relative to the housing 144, can bias either one, the other, or both pawls 154 into contact with the spline 148 to, thus, provide a ratcheting mechanical connection in either of two directions, or a rigid mechanical connection, between the two retention portions 140, independently from one another. A retaining cover 168 and a retaining ring 170 hold the selector dial 164 rotatably free but axially engaged with the housing 144, while a bushing 172 closes a radial portion of the bore 152 to rotatably support but axially retain the spline 148 in axial alignment with the cavity 145.

When the tool 100 is assembled into a condition for use, the reversible tool holder assembly 104 is inserted with one of the first or second barrel 128 or 130 going into the bore 108 of the handle 102 until one of the retention portions 140 engages the locking portion 119 of the collet 116. Releasable locking between the retention portion 140 and the locking portion 119 is accomplished when the two spheres 118, which protrude within the central bore opening of the locking portion 119, engage the retention portion 140, and are pushed outward thereby against the ring spring 120, which provides a biasing, radially inward force. As the retention portion is pushed axially deeper into the handle 102, the depressions of the partial channel 142 come into axial alignment with the spheres 118, at which point the spheres 118 snap into the depressions 142, optionally, with an audible clicking sound.

At this position, the restoring radial force of the ring spring 120 onto the spheres 118 resists their radially outward motion from the depressions in the partial channel 142, and the axial engagement or interference of the sidewalls of the partial channel 142 spheres 118, together or in combination resist the axial withdrawal of the retention portion 140 on the reversible tool holder assembly 104 from the locking portion 119 of the collet 116 and, thus, the handle 102. When a user desires to reverse the reversible tool holder assembly 104, the user pulls on the reversible tool holder assembly 104 and overcomes the engagement between the retention portions 140 and 119 to permit removal, reversing, and re-insertion of the opposite end of the reversible tool holder assembly 104 into the handle 102. The bore 108 of the handle 102 is sufficiently deep to accommodate one of the barrels 128 and 130, and the driver bit installed 134 and 138, installed therein, internally to the handle.

One advantage of the tool 100 relative to other reversible tools is the incorporation of a ratcheting mechanism into the tool. Moreover, the ratcheting mechanism of the tool 100 is entirely contained within the removable and reversible tool holder, and is not part of the handle 102 in the uninstalled condition, which greatly simplifies the design of the handle and also permits the interchangeability of many various tool holders such as nut drivers and the like while permitting use of the same handle for all. In addition, incorporation of the ratcheting mechanism entirely within the reversible tool holder permits use of the holder with different handles and/or power tools, as an extension, and without use or damage done to the handle. Moreover, incorporation of the ratcheting mechanism separately from the handle permits a construction in which an outer diameter of the selector dial 164 is smaller than a diameter of the handle 102, especially the finger grip 114 (FIG. 1) so that a user may not accidentally move the selector dial 164 during use of the tool, as was the case typically with prior designs.

Figure 6:
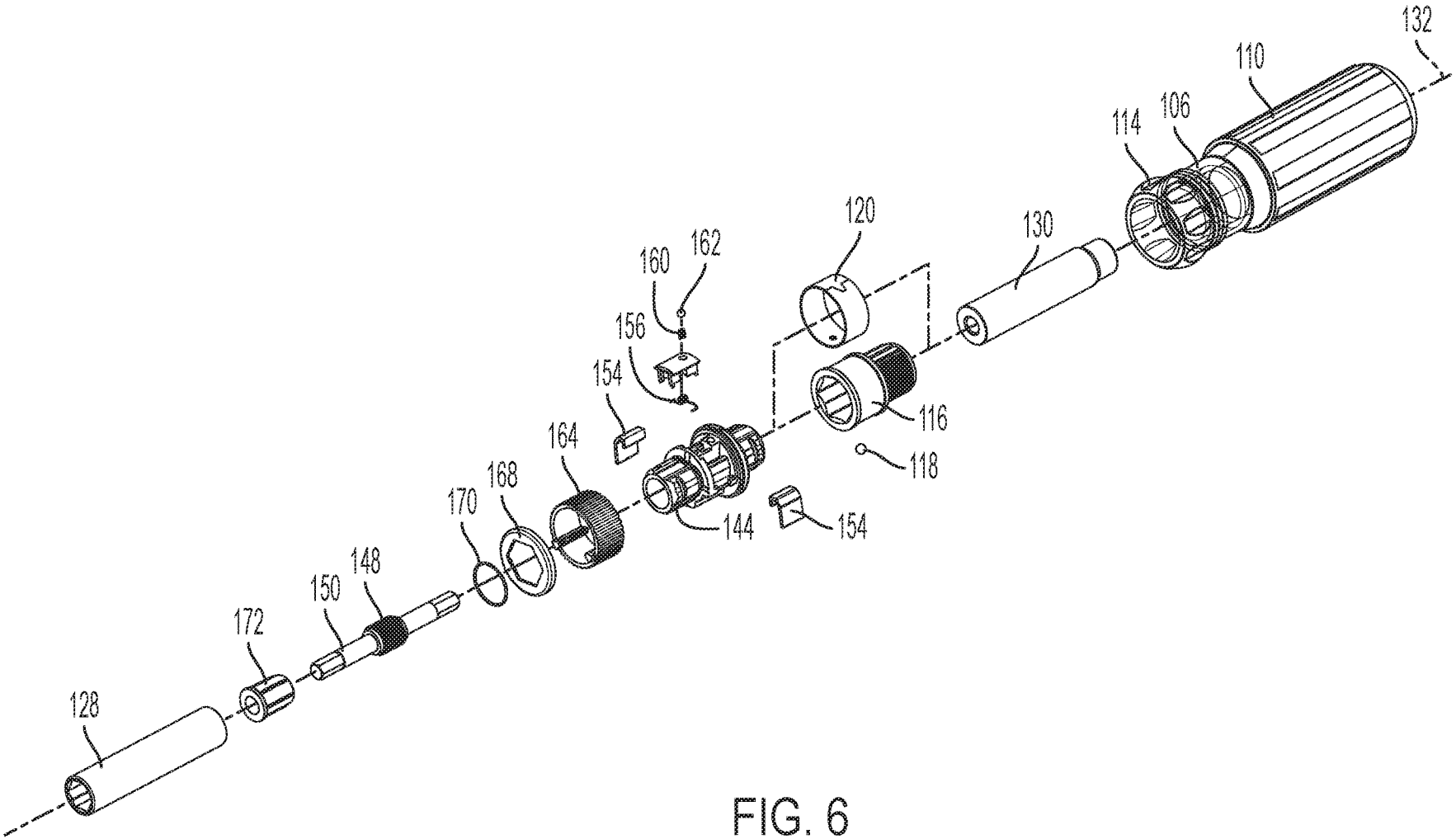
FIG. 6 is an exploded view of an alternative embodiment for a tool in accordance with the disclosure.

An exploded view of the tool 100 with all components described herein and in accordance with a different embodiment in which a friction fit is used to lock the tool holder with the collet 116 is shown in FIG. 6, in which structures that are the same or similar to previously described structures are denoted by the same reference numerals as were previously used for simplicity.

Figure 7:
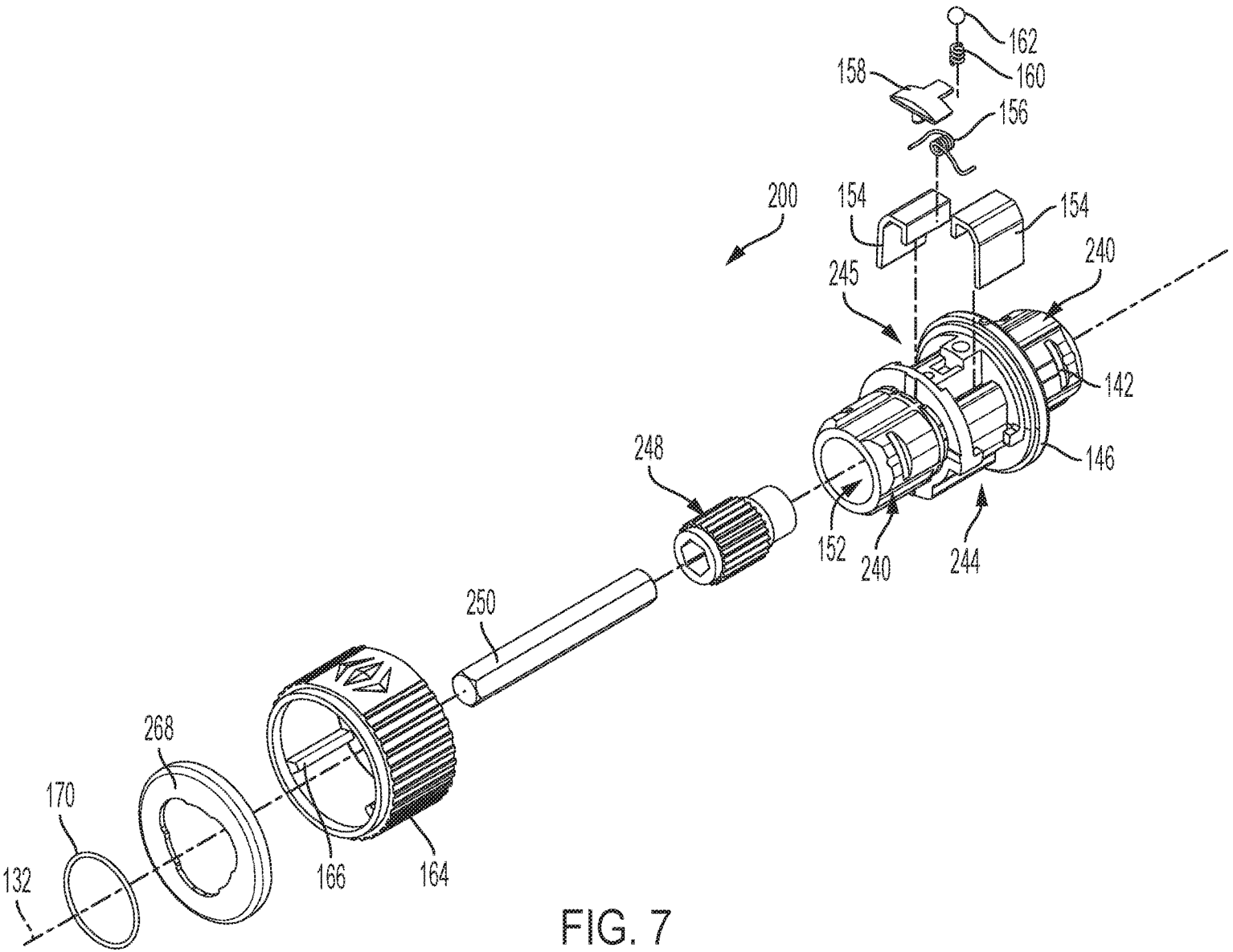
FIG. 7 is an exploded view of an alternative embodiment of a ratchet mechanism.

An exploded view of an alternative embodiment of a ratcheting mechanism 200 is shown in FIG. 7. In this embodiment, the same, like or similar structures described in previous embodiments are denoted by the same reference numerals as previously used for simplicity. In this embodiment, the ratcheting mechanism 200 includes a ratchet housing 244 that is integrally formed with the retention portions 240. As can be seen here, the retention portions 240 do not have a hexagonal external profile, as did the retention portions 140 shown in the embodiment of FIG. 5, but still include the partial channels 142 used to lock the retention portions 240 into the handle of the tool. The retention portions 240 otherwise have a cylindrical outer profile that includes protrusions used to provide a radial height into which the partial channels 142 are disposed.

The housing 244 further includes a cavity 245 that houses components of the ratcheting mechanism, and a flange 146 adjacent the cavity 245. A spline 248 having a barrel shape is formed as a separate component that slides onto a shaft 250, which has a hexagonal profile. The hexagonal profile of the shaft 250 is useful in rotatably engaging the spline 248 with the first and second barrels 128 and 130 (shown in FIG. 3 for a similar embodiment). The shaft 250, like the shaft 150 (FIG. 5), rotatably extends through a bore 152 formed in the housing 244 such that the spline 248 is rotatably supported within the cavity 245. The spline 248 has teeth formed along its outer peripheral surface, which directionally engage the tips of two pawls 154 that are pivotally mounted on the housing 244 adjacent the cavity 245. A spring 156 biases the pawls 154 to selectively contact the spline 248. A cover 158 retains the pawls in position. A locking spring 160 biases a ball 162 in a radial outward direction within a bore in the cover 158 and against an inner surface of a selector dial 164 that is disposed around the housing 244 and over the cavity 245.

Similar to the embodiment shown in FIG. 5, the selector dial 164 has a hollow cylindrical shape and includes two selector actuators 166 along an inner wall surface thereof that, depending on the rotational orientation of the selector dial 164 relative to the housing 244, can bias either one, the other, or both pawls 154 into contact with the spline 248. In this way, a ratcheting mechanical connection in either of two rotational directions, or a rigid mechanical connection, between the two retention portions 240, independently from one another, can be provided. A retaining cover 268, which has an internal opening profiled to correspond to the shape of the retention portions 240, and a retaining ring 170, to hold the selector dial 164 rotatably free but axially engaged with the housing 244. In the embodiment shown, the non-circular shape of the retention portions 240 includes in cross section an inner circle with curved protrusions, which provide engagement with the collet 116, and which for this embodiment will have a corresponding non-circular shape to matingly engage the retention portion 240. The resulting shape of the retention portions 240, therefore, assumes a cylindrical core with three, or any number, of convex protrusions that held transmit torque from the handle to the driver or bit when engaged with the collet 116.

Figure 8:
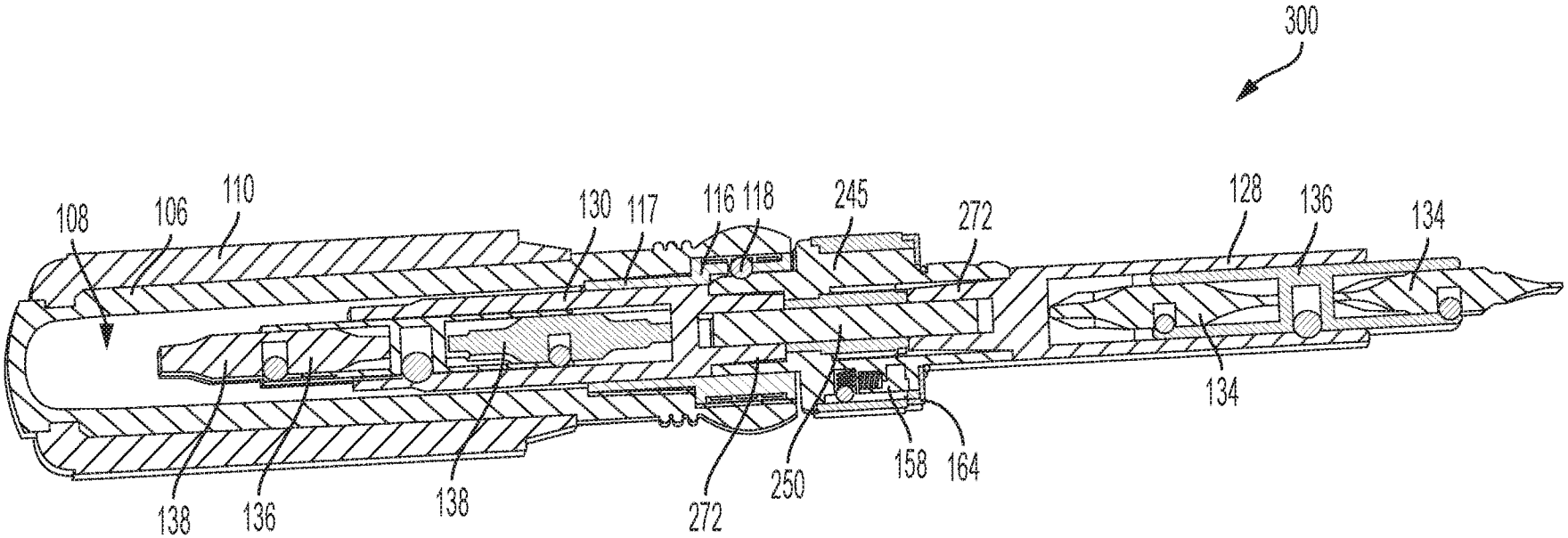
FIG. 8 is a cross section of a tool including the ratchet mechanism of FIG. 7.

A cross section through a tool 300, which includes the ratcheting mechanism 200, is shown in FIG. 8. In this embodiment, it can be seen that the ends of the first and second barrels 128 and 130 form bushings 272 that help retain, center and rotatably mount the shaft 250 into the housing 245. The remaining structures and their relation as discussed above can also be seen. For example, the barrels 128 and 130 have internal bores into which tool holders 136 are disposed. Each tool holder has a generally hollow cylindrical shape that accommodates two bits or drivers 134 or 138 in either end. Each driver or bit has two different (or the same) drive ends such that, in total, the tool 300 can be used with eight interchangeable drives or bits.

As discussed above, one advantage of the hand tools discussed herein is that the ratcheting mechanism is integrated with the tool holder barrels and is separate or independent from the handle. In this way, the selector dial is distanced from the handle, which reduces the likelihood of accidental changes in ratcheting direction during use, and is also easier to clean and inspect when not in use.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A reversible hand tool, comprising:

a handle having a body portion that includes a hollow bore formed at least partially through the body portion, and a grip; and a reversible tool holder assembly, the reversible tool holder assembly including a ratcheting mechanism, a first barrel disposed on one side of the ratcheting mechanism, and a second barrel disposed in axial alignment with the first barrel on an opposite side of the ratcheting mechanism, the reversible tool holder assembly being insertable into and releasably engageable with the hollow bore of the body portion of the handle in either of two orientations to present two different ends extending from the handle;

wherein the ratcheting mechanism is configured to provide a reversible ratcheting mechanical connection between the first and second barrels and the handle, the ratcheting mechanism comprising a ratchet housing and a spline disposed in the ratchet housing and having teeth formed to directionally engage at least one pawl that is disposed in the ratchet housing.

2. The reversible hand tool of claim 1, further comprising a collet connected into an open end of the hollow bore, wherein the ratcheting mechanism releasably engages the collet.

3. The reversible hand tool of claim 2, wherein the collet includes a locking portion having a generally cylindrical shape and forming an internal bore.

4. The reversible hand tool of claim 3, wherein the internal bore has a hexagonal shape that matingly engages a corresponding hexagonal retention portion associated with the ratcheting mechanism.

5. The reversible hand tool of claim 3, wherein the internal bore has a non-circular shape that matingly engages a corresponding retention portion associated with the ratcheting mechanism.

6. The reversible hand tool of claim 1, wherein the hollow bore in the handle is a through-bore that is open on both ends.

7. A reversible hand tool, comprising a handle having a body portion that includes a hollow bore formed at least partially through the body portion, and a grip;

a reversible tool holder assembly, the reversible tool holder assembly being insertable into the hollow bore of the body portion of the handle in either of two orientations to present two different ends extending from the handle, the reversible tool holder assembly including a first barrel and a second barrel that are axially aligned, and a ratcheting mechanism disposed between the first and second barrels;

wherein the ratcheting mechanism is configured to provide a reversible ratcheting mechanical connection between the first and second barrels, the ratcheting mechanism comprising:

a ratchet housing that includes a cavity;

a flange disposed adjacent the cavity;

a spline having a barrel shape, the spline disposed along a shaft that rotatably extends through a bore formed in the housing such that the spline is rotatably supported within the cavity;

wherein the spline has teeth formed along its outer peripheral surface, the teeth disposed to directionally engage tips of at least one of two pawls that are pivotally mounted on the housing adjacent the cavity;

a spring disposed to bias the pawls to selectively contact the spline; and a cover disposed to retain the pawls in position;

wherein the ratcheting mechanism is releasably connectable with the handle in either of the two orientations such that either the first barrel or the second barrel extends from the housing and the reversible ratcheting mechanical connection is applied between the first or second barrel and the handle.

8. The reversible hand tool of claim 7, wherein the spline is slidably disposed and rotatably engaged relative to the shaft.

9. The reversible hand tool of claim 7 further comprising a selector dial disposed around the housing and over the cavity, wherein the selector dial includes two selector actuators along an inner wall surface thereof that, depending on a rotational orientation of the selector dial relative to the housing, can bias either one, the other, or both pawls into contact with the spline to provide a ratcheting mechanical connection in either of two directions, or a rigid mechanical connection, between the two retention portions independently from one another.

10. A tool insert, comprising:

a reversible tool holder assembly, the reversible tool holder assembly being adapted for insertion into a handle in either of two orientations to present two different ends extending from the handle, the reversible tool holder assembly including a first barrel and a second barrel that are axially aligned, and a ratcheting mechanism;

wherein the ratcheting mechanism is disposed axially between the first and second barrels, the ratcheting mechanism configured to provide a reversible ratcheting mechanical connection or a solid mechanical connection between the first and second barrels, the ratcheting mechanism comprising a ratchet housing and a spline disposed in the ratchet housing and having teeth to directionally engage at least one pawl that is disposed in the ratchet housing.

11. A tool insert, comprising a reversible tool holder assembly, the reversible tool holder assembly being adapted for insertion into a handle in either of two orientations to present two different ends extending from the handle, the reversible tool holder assembly including a first barrel and a second barrel that are axially aligned, each of the first and second barrel having a respective free end that defines one of the two different ends; and a ratcheting mechanism disposed axially between the first and second barrels, the ratcheting mechanism being releasably insertable and removable from the handle, the ratcheting mechanism configured to provide a reversible ratcheting mechanical connection or a solid mechanical connection between the first and second barrels, the ratcheting mechanism comprising:

a ratchet housing that includes a cavity;

a flange disposed adjacent the cavity;

a spline having a barrel shape, the spline disposed along a shaft that rotatably extends through a bore formed in the housing such that the spline is rotatably supported within the cavity, wherein the first and second barrels are connected to one another along the shaft;

wherein the spline has teeth formed along its outer peripheral surface, the teeth disposed to directionally engage tips of at least one of two pawls that are pivotally mounted on the housing adjacent the cavity;

a spring disposed to bias the pawls to selectively contact the spline; and a cover disposed to retain the pawls in position.

12. The tool insert of claim 11, wherein the spline is slidably disposed and rotatably engaged relative to the shaft.

13. The tool insert of claim 11, further comprising a selector dial disposed around the housing and over the cavity, wherein the selector dial includes two selector actuators along an inner wall surface thereof that, depending on a rotational orientation of the selector dial relative to the housing, can bias either one, the other, or both pawls into contact with the spline to provide a ratcheting mechanical connection in either of two directions, or a rigid mechanical connection, between the two retention portions independently from one another.

14. A method for operating a tool, comprising:

providing a handle having a body portion that includes a hollow bore formed at least partially through the body portion, and a grip;

releasably inserting a reversible tool holder assembly into the hollow bore of the body portion of the handle in either of two orientations to present two different ends extending from the handle, the reversible tool holder assembly including a first barrel and a second barrel that are axially aligned; and operating a ratcheting mechanism disposed axially between the first and second barrels, the ratcheting mechanism configured to provide a reversible ratcheting mechanical connection between the first and second barrels;

wherein the ratcheting mechanism is releasably connectable with the handle in either of the two orientations such that the reversible ratcheting mechanical connection is applied between either of the two different ends extending from the handle, and the handle, independently from the handle.

15. The method of claim 14, further comprising providing a collet connected into an open end of the hollow bore of the handle, and releasably engaging the collet with the ratcheting mechanism.

16. The method of claim 14, further comprising matingly engaging corresponding retention portions of the ratcheting mechanism and the handle using non-circular cross sections to rotatably engage the handle with one side of the ratcheting mechanism.

17. The method of claim 14, wherein the ratcheting mechanism includes:

a ratchet housing that includes a cavity;

a flange disposed adjacent the cavity;

a spline having a barrel shape, the spline disposed along a shaft that rotatably extends through a bore formed in the housing such that the spline is rotatably supported within the cavity;

wherein the spline has teeth formed along its outer peripheral surface, the teeth disposed to directionally engage tips of two pawls that are pivotally mounted on the housing adjacent the cavity;

a spring disposed to bias the pawls to selectively contact the spline; and a cover disposed to retain the pawls in position.

18. The method of claim 17, wherein the spline is slidably disposed and rotatably engaged relative to the shaft.

19. The method of claim 17, further comprising a selector dial disposed around the housing and over the cavity, wherein the selector dial includes two selector actuators along an inner wall surface thereof that, depending on a rotational orientation of the selector dial relative to the housing, can bias either one, the other, or both pawls into contact with the spline to provide a ratcheting mechanical connection in either of two directions, or a rigid mechanical connection, between the two retention portions independently from one another.

20. The method of claim 19, further comprising placing the selector dial in a first, second or third positions to provide a ratcheting action in a first direction or a second direction, or to lock the ratcheting mechanism in a solid mechanical connection.

* * * * *